US010023445B2

(12) United States Patent
Boulliat

(10) Patent No.: US 10,023,445 B2
(45) Date of Patent: Jul. 17, 2018

(54) PORTABLE POWER DRIVEN SYSTEM COMPRISING A ROPE GRAB ARRANGEMENT

(71) Applicant: Actsafe Systems AB, Lindome (SE)

(72) Inventor: Claude Boulliat, Grenoble (FR)

(73) Assignee: ACTSAFE SYSTEMS AB, Lindome (SE)

( * ) Notice: Subject to any disclaimer, the term of this patent is extended or adjusted under 35 U.S.C. 154(b) by 1 day.

(21) Appl. No.: 15/128,978

(22) PCT Filed: Mar. 31, 2015

(86) PCT No.: PCT/EP2015/057125
§ 371 (c)(1),
(2) Date: Sep. 25, 2016

(87) PCT Pub. No.: WO2015/155082
PCT Pub. Date: Oct. 15, 2015

(65) Prior Publication Data

US 2017/0107086 A1 Apr. 20, 2017

(30) Foreign Application Priority Data

Apr. 7, 2014 (EP) ..... 14163722

(51) Int. Cl.
*B66D 1/74* (2006.01)

(52) U.S. Cl.
CPC ..... *B66D 1/7415* (2013.01); *B66D 1/7489* (2013.01); *B66D 2700/0141* (2013.01)

(58) Field of Classification Search
CPC .. B66D 1/7415; B66D 1/7426; B66D 1/7447; B66D 1/7489; B66D 2700/0141; A62B 1/06; A62B 1/10
See application file for complete search history.

(56) References Cited

U.S. PATENT DOCUMENTS 3,276,745 A * 10/1966 Mauldin ..... B66D 1/7447 254/311
3,375,725 A * 4/1968 Mathison ..... F16H 55/38 474/153
3,819,155 A * 6/1974 Smith ..... A01K 91/06 254/361
3,949,969 A 4/1976 Kaufer
4,923,055 A * 5/1990 Holland ..... B66B 1/32 187/287

(Continued)

FOREIGN PATENT DOCUMENTS

FR 2632374 12/1989
WO 2007103035 9/2007

OTHER PUBLICATIONS

Javor Ribarov; International Search Report, Parent PCT Application: PCT/EP205/057125, Jun. 1, 2015; European Patent Office, Rijswijk NL.

*Primary Examiner* — Emmanuel M Marcelo
(74) *Attorney, Agent, or Firm* — Babcock IP, PLLC

(57) ABSTRACT

The present invention relates to a rope grab arrangement comprising a rope grab for advancing a rope, the rope grab arrangement being configured to provide an increased friction between the rope grab and the rope for allowing use of multitude of different types of ropes. The invention also relates to a portable power driven arrangement comprising such a rope grab arrangement.

16 Claims, 7 Drawing Sheets

(56) References Cited

U.S. PATENT DOCUMENTS

| | | | | |
|---|---|---|---|---|
| 5,238,227 | A * | 8/1993 | White | B66D 1/7415 254/334 |
| 5,722,640 | A * | 3/1998 | Skyba | B66D 1/7415 254/333 |
| 6,412,602 | B1 | 7/2002 | Sundman | |
| 6,719,275 | B1 * | 4/2004 | Waterson | B63G 8/39 226/171 |
| 6,793,046 | B2 * | 9/2004 | Petzl | A62B 1/14 188/188 |
| 7,137,481 | B2 * | 11/2006 | Petzl | A62B 1/10 182/191 |
| 9,192,792 | B2 * | 11/2015 | Moine | A63B 29/02 |
| 2008/0157042 | A1 * | 7/2008 | Jacobson | B66B 9/00 254/270 |
| 2008/0203370 | A1 | 8/2008 | Ball et al. | |
| 2013/0240811 | A1 * | 9/2013 | Wilson | A62B 1/10 254/342 |
| 2015/0123058 | A1 * | 5/2015 | Melin | B66D 1/7415 254/362 |

* cited by examiner

PORTABLE POWER DRIVEN SYSTEM COMPRISING A ROPE GRAB ARRANGEMENT

TECHNICAL FIELD

The present invention relates to a rope grab arrangement comprising a rope grab for advancing a rope, the rope grab arrangement being configured to provide an increased friction between the rope grab and the rope for allowing use of multitude of different types and diameters of ropes, belt, strip or hanger. The invention also relates to a portable power driven arrangement comprising such a rope grab arrangement.

BACKGROUND OF THE INVENTION

Powered personal lifting devices assist personnel in scaling vertical surfaces. Motorized winches are used to raise or lower personnel on platforms or harnesses attached to ropes. A winch must be anchored to a solid platform above the load or use pulleys coupled to the platform to hoist the load. Further, a winch winds the rope or cable on a spool which limits the length and weight of rope that can be used. Hoists, usually with compound pulleys or reducing gears are used to raise or lower individuals or platforms and must be suspended from a secure support point such as a tripod, beam or bridge crane. Typically a winch or hoist requires at least a second person to operate or control the device in order for a first person to safely ascend a rope.

There are however many examples of where it would be desirable to have access to a portable winch, preferable for a portable winch that can be operated by the person ascending or descending the rope. Such scenarios include for example mountain climbing, caving, tree trimming, rescue operations and military operations. Industrial uses of a climbing device may include scaling tall structures, towers, poles, mine shafts or bridge works for servicing, cleaning, window washing, painting, etc.

An example of such a portable winch is disclosed in U.S. Pat. No. 6,412,602. In U.S. Pat. No. 6,412,602 there is provided a promising approach to a portable climber operated winch, denoted as a climbing device, comprising a rotatable rope pulley connected to a motor, such as for example an internal combustion motor or an electric battery powered motor. During operation of the climbing device a rope is introduced in the rope pulley, and once the motor is engaged and starts to rotate, the rope pulley may advance the climber in a typically vertical direction along the rope.

Even though the above mentioned prior art shows a very useful solution for rope access to heights, there is always an endeavor to introduce further improvements for the personnel utilizing the equipment. Specifically, there is a desire to minimize any risks when working at heights, thereby improving the environment for the user of such equipment.

SUMMARY OF THE INVENTION

According to a first aspect of the invention, the above is at least partly alleviated by a rope grab arrangement for a portable power driven system, the portable power driven system configured for advancing a rope, the rope grab arrangement comprising an essentially circular rope grab, wherein the rope grab is configured to, during operation, engage the rope along at least a section of a circumference of the rope grab, wherein the rope grab is further configured to be connected to a drive shaft of a motor of the power driven system for rotation of the rope grab, and a securing device comprising a first roller, the securing device arranged adjacently to the rope grab and configured to, by means of the first roller, exert a pressure to the rope for forcing the rope towards the rope grab at a portion of the section where the rope, during operation, is engaging the rope grab, wherein a rope engaging face of the rope grab has a concave form for engaging the rope and the rope engaging face is provided with a plurality of pins configured to contact the rope along the section of the circumference of the rope grab engaging the rope during operation of the rope grab arrangement.

The invention is based on the understanding that it may be possible to, compared to prior art, increase the number of types of robes that may be used with a portable power driven system by making adjustments to the robe grab arrangement, where a thereto provided rope grab will be configured to comprise a plurality of pins arranged to contact the rope during operation. In comparison to prior art, the friction between the rope and the rope grab will be increased, thus increasing the range of useful ropes. For achieving the advantageous effect of an increased friction between the rope and the rope grab, it will be necessary to also include a securing device configured to provide a pressure to the rope at a position where the rope and the rope grab engage, during operation, with each other. This position of engagement between the rope and the rope grab is typically at a stress part of the rope at a portion of the circumference of the rope grab. In turn, the first roller of the securing device will provide the pressure/exert a force at a section of this position. In a preferred embodiment the plurality of pins will at least partly penetrate the rope.

The positioning of the pins within the rope engaging face of the rope grab may in some embodiment be symmetrical, i.e. having a symmetrical distribution at the rope engaging face of the rope grab. However, it may also be possible to position the pins in any other way, typically taking into account the expected load provided to the portable power driven system. This will of course also be valid for determining the number of pins positioning within the rope engaging face of the rope grab.

Within the context of the application, the term roller should be interpreted broadly, and may comprise any type of device that can rotate "along with the rope" at the same time as the pressure is provided between the rope and the rope grab. Accordingly, the first roller should preferably be configured to provide a pressure that still allows the first roller to rotate during operation (rotation of) the rope grab.

As mentioned above, the motor is connected to the rope grab using the drive shaft. The expression "drive shaft" may include any mechanical implementation for transferring a rotational force from the motor to the rope grab. As such, the drive shaft may for example further include a gearbox or similar for adapting the rotational force to suit the rotational speed of the rope grab. The term rope is here used in its broader sense and is intended to include ropes, wires, belts, webbing, and cords of whatever nature or size suitable for engaging with the rope grab. As understood by this definition, the rope may have a circular, elliptic of essentially flat (e.g. rectangular) form.

In a preferred embodiment, a length of the pins is selected to not fully pierce through the rope. Preferably, the length is configured such that they engage themselves in the full woven part of rope, belt, strip or hanger, however with a minimum penetration of the "core" of the rope. The general structure of a rope suitable for use with a portable power driven system as discussed above will be readily understood by the person skilled in the art.

In an embodiment, the rope grab and the pins are manufactured from a metal material, preferably keep as light as possible for reducing the overall weight of the power driven system. However, within the concept of the invention, it may also be possible to manufacture the rope grab and/or the pins out of a resistant plastic material, such as for example being manufactured from a polyoxymethylene material. It is of course understood that other suitable plastic material having high resistance may be useable within the context of the invention.

The pins and the rope grab are preferably manufactured as a single unit. This may in some implementations be preferred due to cost of manufacturing. One possibility would for example be to manufacture the single unit rope grab from cast iron. Alternatively, the rope grab may be formed as one unit and the plurality of pins may be integrated with the rope grab, for example by insertion in holes formed at the engaging face of the rope grab.

In another embodiment the rope grab is assembled from a plurality of identical segments, assembled together to form an equivalent of a single unit as discussed above. Such segments may be made of metal or plastic as discussed above. Advantages with such an embodiment may in some cases relate to simplified manufacturing giving a decreased manufacturing cost.

Within the context of the invention, it may be possible to provide at least the engaging face of the rope grab with a rubber material or a similar equivalent, further improving the friction between the rope grab and the rope. The selection of material may be dependent on a possible temperature increase relating to the use of the additional e.g. rubber material when operating the portable power driven system.

The portion of the pin adapted to penetrate the rope is preferably configured to have an in comparison "pointy" end. That is, the end of the pins provided to penetrate the rope has an angled form, having an angle typically between 0-45 degrees. In a preferred embodiment of the invention, the outermost end of the pins adapted to penetrate the rope, sometimes denoted as the "attack front" of the pins, may preferably be configured to have a typical angle between −5-22 degrees, thereby giving less wear and tear of the rope. This may specifically be achieved by arranging the pins to be "rounded off" and has a beam between 0 to 0.5 mm. In a possible embodiment the pins have a diameter between 0.5 to 2.5 mm, preferably around 2 mm. In a possible embodiment the spherical headland of the pins may, for example, have a radius around 0.5 mm and may be placed on the top of a cylinder of 1 mm of diameter and of 1 mm of length.

In an embodiment, the securing device further comprises a first elongated lever, the first elongated lever at a first end having a hinged connection to the portable power driven system and at a second end configured to receive the first roller. The first elongated lever may in such an embodiment be provided with some form of spring mechanism forcing the first roller towards the rope grab.

In another embodiment, the securing device further comprises a second elongated lever, the second elongated lever at a first end having a hinged connection to the first end of the first elongated lever and at a second end provided with a second roller positioned to, during operation, engage with the rope at the section of the circumference of the rope grab. Accordingly, instead of providing the first elongated lever with a spring mechanism for forcing the first roller towards the rope grab, the second roller will also be engaged with the rope and, during operation when the portable power driven system is having a loading force applied thereto, be configured to increase an angle between the first and the second elongated lever such that the above discussed force will be applied towards the rope grab. The advantage of this improvement is that the forcing load on the first roller is proportional to the carry load. The securing device may further comprise means configured to keep the first and the second lever at a predetermined minimum work angle. Such means may for example be implemented by arranging a bolt or any other type of means at the hinge portion of the first and the second lever.

Preferably, the rope grab arrangement as discussed above is comprised with a portable power driven system for advancing a rope, the rope extending in a first main direction, the power driven system further comprising a motor comprising a drive shaft, and a main body for mounting the motor and the rope grab arrangement, the main body further comprising an anchoring point adapted to receive an anchoring force, the anchoring force extending in a second direction being essentially opposite to the first main direction.

In an embodiment of the invention there is further provided an elongated safety sling connected to the anchoring point, the safety sling arranged to receive at least one of a maillon, a carabiner, or a rigging plate. The sling may for example be of a textile material. The elongated sling is preferably at one of its ends connected to the anchoring point and configured to at its other end receive at least one of a maillon, a carabiner, or a rigging plate. The at least one of a maillon, a carabiner, or a rigging plate may then in turn be used for allowing connection of the portable system to e.g. a harness for a user, or for anchoring the system to a fixed structure using e.g. further climbing/fining equipment. The general term "elongated sling" is typically referred to as in relation to general climbing equipment. In addition, the term "textile" should be interpreted very broadly. For example, the textile material used for forming the sling may be of any type of e.g. woven or non-woven material, natural and/or synthetic fibers, etc. During operation of the portable power driven system, the user is typically securely connected to the above discussed anchoring point, e.g. by means of the sling and carabiner.

In addition, the portable system may further comprise wireless reception means configuring the system to be controlled from a distance using for example a remote control, thus allowing for example a second operator to control the portable power driven system from a distance.

Preferably, the portable power driven system further comprises a hinged safety arrangement comprising a safety lid configured to be arranged in a closed state to cover the rope grab during operation of the power driven system, and to be arranged in an opened state for allowing introduction of the rope to the robe grab. Such a safety arrangement minimizes any risks of the user introducing e.g. a hand or similar, efficiently increasing the operational safety of the system.

In a preferred embodiment, the motor is an electrical motor, and the portable power driven system further comprises a gear arrangement connected in between the electrical motor and the rope grab, the gear arrangement configured to reduce a rotational speed of the rope grab as compared to a rotational speed of the motor. This will as a result increase the torque applied to the rope grab, thus making it possible to use a high speed motor with a low torque Preferably, the gear arrangement comprises a worm drive, where the worm drive is configured to be self-locking. This has the advantages of not having to include a break mechanism with the portable power driven system, thus decreasing the cost and complexity of the portable power driven system.

When using a high speed motor with a low torque as discussed above, it is typically desirable to further include a centrifugal clutch connected between the motor and the gear arrangement. Such a centrifugal clutch will be used for compensation of the weakness of the motor torque at the start phase of the motor.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figures 1A, 1B:
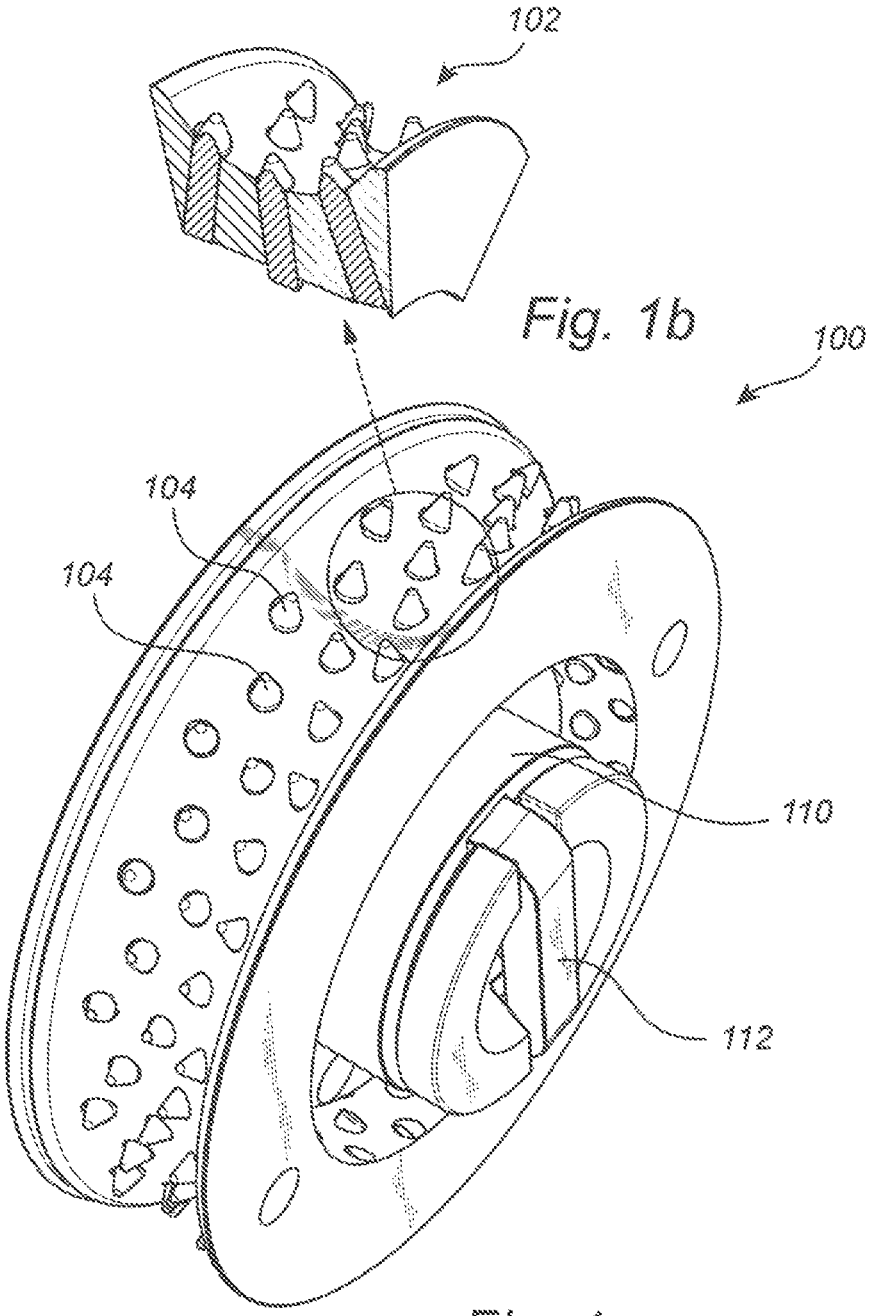
FIGS. 1*a*-1*g* show embodiments of robe grab according to currently preferred embodiments of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIGS. 1*a* and 1*b* in particular, there is depicted a rope grab 100 configured to be used with a portable power driven system, the rope grab 100 illustrated according to a possible embodiment of the invention. The rope grab 100 has an essentially circular shape, including a rope engaging face 102 having a concave form. The rope engaging face 102 is arranged at the circumference of the essentially circular rope grab. The concave form of the rope engaging face 102 is preferably somewhat rounded ("u shaped"), however in some instances it may be desirable to allow the rope engaging face 102 to be somewhat "v shaped". In a currently preferred embodiment, the diameter of the rope grab is around 50 mm. However, it may, depending on the rope and overall design of the portable power driven system.

The rope engaging face 102 is provided with a plurality of pins 104 configured to penetrate a rope (not explicitly shown in FIGS. 1*a* and 1*b* but will be further detailed below) during operation of the rope grab 100. The pins 104 may in one embodiment, and as is detailed in FIG. 1*b* be inserted from the center of the rope grab 100 in a direction towards the rope engaging face 102 such that the pins 104 are protruding at the rope engaging face 102, that is within the convex area of the rope grab 100.

The number and positioning of the plurality of pins 104 protruding at the rope engaging face 102 may be dependent on the general type of rope to be used together with the rope grab 100. In the embodiment illustrated in FIGS. 1*a* and 1*b*, the pins 104 are arranged symmetrically in a plurality of parallel "lines" being somewhat shifted in relation to each other. As such, there will be an essential equal density of pins per unit (e.g. pins per square centimeter). However, it should be understood that any other form of distribution of the pins 104 is possible and within the scope of the invention. In a possible embodiment, there may for example be provided 5-6 pins 104 per square centimeter in case the load provided to the portable power driven system is expected/dimensioned to be around 250 kg. However, in case of dimensioning the portable power driven system for a less heavy load, for example 150 kg, it may be possible to provide approximately 4-5 pins 104 per square centimeter. Similarly, in case of dimensioning the portable power driven system for a load exceeding 250 kg, it is typically desirable to provide more than 6 pins 104 per square centimeter.

As discussed above, the pins 104 may be inserted from the center of the rope grab 100. In such an embodiment there may additionally be provided some form of fastening means for providing a steady connection between the pins 104 and the rope grab 100. Such fastening means may comprise glue, soldering, welding or configuring the pins 104 to have a shape for "locking" the pins 104 within the rope grab 100. Possibly, the pins 104 and the rope grab 100 may be formed as a single unit, for example by manufacturing the complete element from cast iron or any other similar type of material. Possibly, the single unit may be formed from other materials as well, such as a resilient plastic material.

Furthermore, the rope grab 100 illustrated in FIG. 1*a* is provided with a safety key 112, allowing the rope grab 100 to be disengaged from a drive shaft of the portable power driven system (will be illustrated below in relation to FIGS. 3*a* and 3*c*). By providing such measures it may be possible to allow a user to descend the rope even in case of a malfunctioning motor comprised with the portable power driven system (such as in case of an empty battery). As discussed above the worm drive is preferably configured to be self-locking, as such a malfunctioning motor will make it impossible to descend the rope. Accordingly, it is desirable to include a safety feature such as the safety key 112 for allowing the rope grab to be disengaged from the drive shaft, thus making it possible to descend the rope while disengaging the functionality of the motor.

In addition, it should be noted that the rope engaging face 102 as discussed above may be provided with a rubber material for even further improving the friction between the rope and the rope grab 100/100'. In case of providing a rubber material at the rope engaging face 102, it may be possible to adjust the number of pins 104 per square centimeter, typically allowing for a reduction of pins 104 per square centimeter for the same load.

Figure 1D:
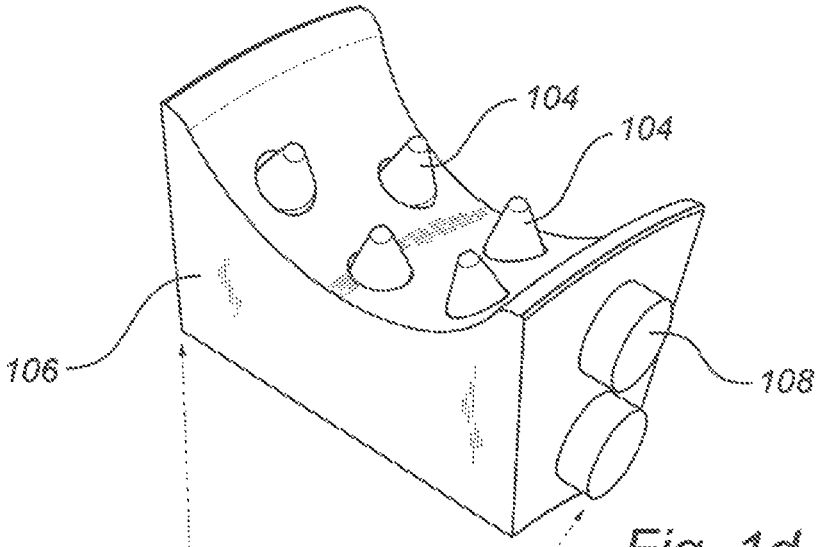
Figure 1C:
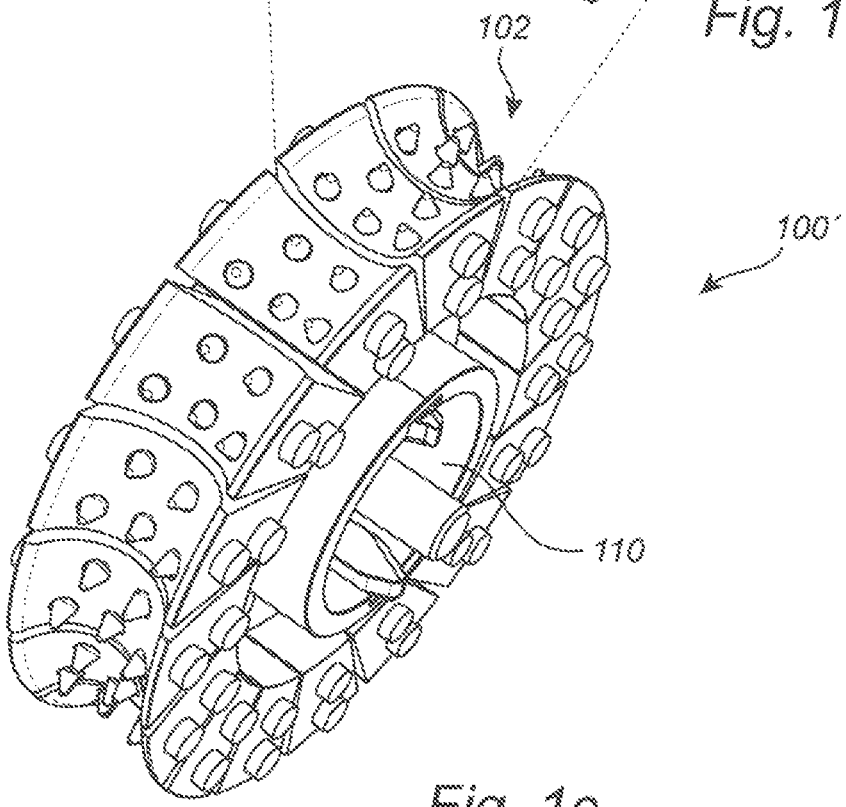

In FIGS. 1*a* and 1*b* the rope grab 100 is provided as a single unit. However, as is indicated in FIGS. 1*c* and 1*d*, the rope grab 100' may be formed from a plurality of pieces 106 configured to engage/connect with each other. The pieces 106 may typically be identical to each other, possibly simplifying the manufacturing process. There may additionally be provided for example a first and a second disc provided with holes (not shown) provided to engage with the protruding portions 108 provided on the sides of the pieces 106, where the holes are arranged to correspond to the position of the protruding portions 108 of the pieces 106 for achieving a sturdy rope grab 100'.

Furthermore, both of the possible rope grabs 100/100' shown in FIGS. 1*a*-1*d* are provided with a centrally arranged recess 110 configured to allow connection to a motor. This will be further discussed below in relation to FIGS. 3*a*-3*c*.

Figure 1E:
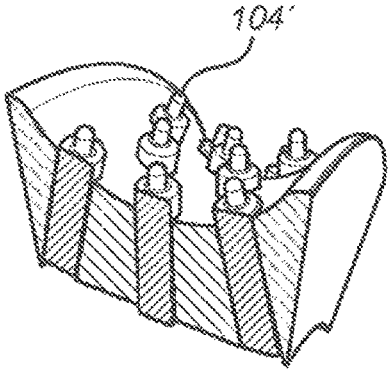

In an alternative embodiment, the plurality of pins 104 as shown in e.g. FIG. 1*a* may be configured to have a slightly different shape/form. As is illustrated in FIG. 1*e*, the pins 104' may be configured to have a cylindrical base shape with a top portion comprising a small protrusion to contact with the rope.

Figure 1F:
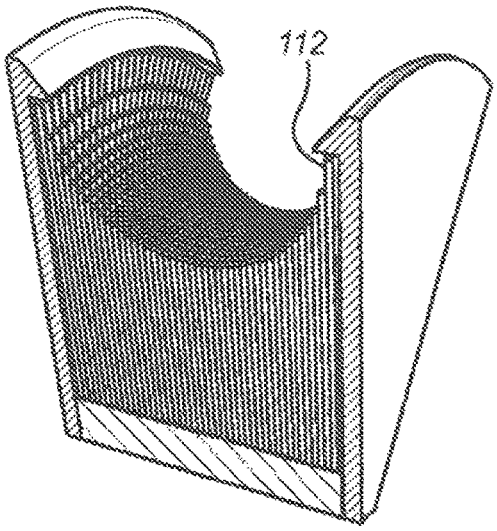

In a still further alternative embodiment, as is illustrated in FIG. 1*f*, the rope grab 100 may comprise a plurality of pins in the form of a plurality of flexible "bristles" 112 (typically of metal) for contacting the rope. The number of bristles 112 may depend of the capability of the bristles 112 to keep the rope in a good position against them: Too many bristles 112 and the rope remain on the top of the bristles 112 and can slip. Not enough bristles 112 and the rope will engage too much itself in the wire and can destroy it self. In this solution, it is desirable to arrange the tope of each of the bristles 112 to be spherical. One advantage with this solution is that the elongation of the rope (coming from the stress) is absorbed by the flexibility of the bristles 112.

Figure 1G:
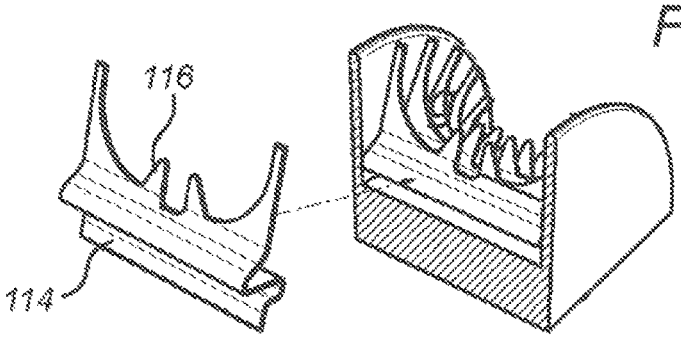

As an alternative to the pins shown in FIGS. 1*a*-1*e*, it may, as is shown in FIG. 1*g*, alternatively be possible to arrange a plurality of spring blades 114 for contacting the rope. Each of the spring blades 114 are in turn provided with one or a plurality of extensions 116 provided for contacting the rope. It is within the scope of the invention possible to arrange one or a plurality of extensions 116 with each of the blades 114. The number of extensions 116 may also be different for each of the blades 114. The spring functionality provided by the blades 114 provides similar advantages as mentioned in relations to the flexible bristles 112.

Figure 2:
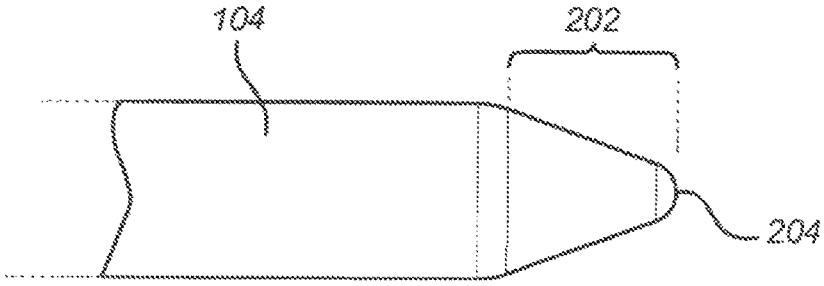
FIG. 2 shows a detailed view of a pin comprised with the rope grabs as shown in FIGS. 1*a*-1*d;*

In FIG. 2 there is provided a detailed view of portion of a pin 104 to be used with a rope grab 100/100' as discussed above. The pin 104 is typically of cylindrically shaped, even though other possibilities exists and are within the scope of the invention. The pin 104 is provided with an angled end portion 202, this portion of the pin 104 configured to engage with the rope. The angled, i.e. "pointy" end portion 202 may typically be sub-divided into two sections, having an overall angle of between 0-45 degrees, where the outmost tip 204 has been rounded off, having a further angle of between −5-22 degrees. By providing the tip 204 with a rounded off edge, less wear and tear is provided to the rope during operation. Typically, the overall diameter of the pin 104 (in case of the pin 104 being in the shape of a cylinder, i.e. a diameter of the cylinder and not the diameter of the rounded tip 204) is selected to be between 2-5 mm, preferably around 3.5 mm.

Figures 3A, 3B:
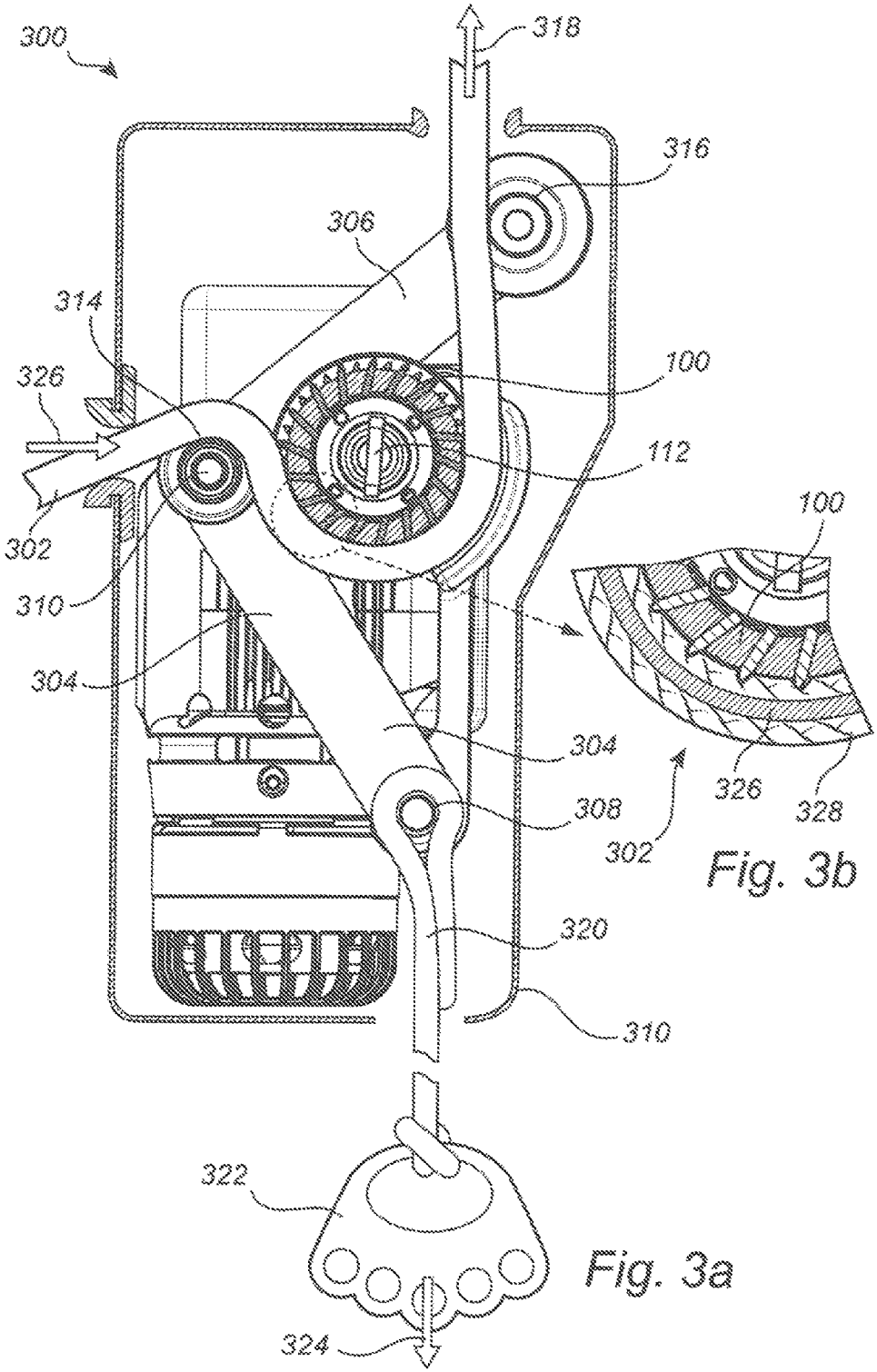
FIG. 3*a*-3*c* show conceptual side views and detailed illustrations of a power driven system comprising a rope grab arrangement according to a currently preferred embodiment of the invention.
Figure 3C:
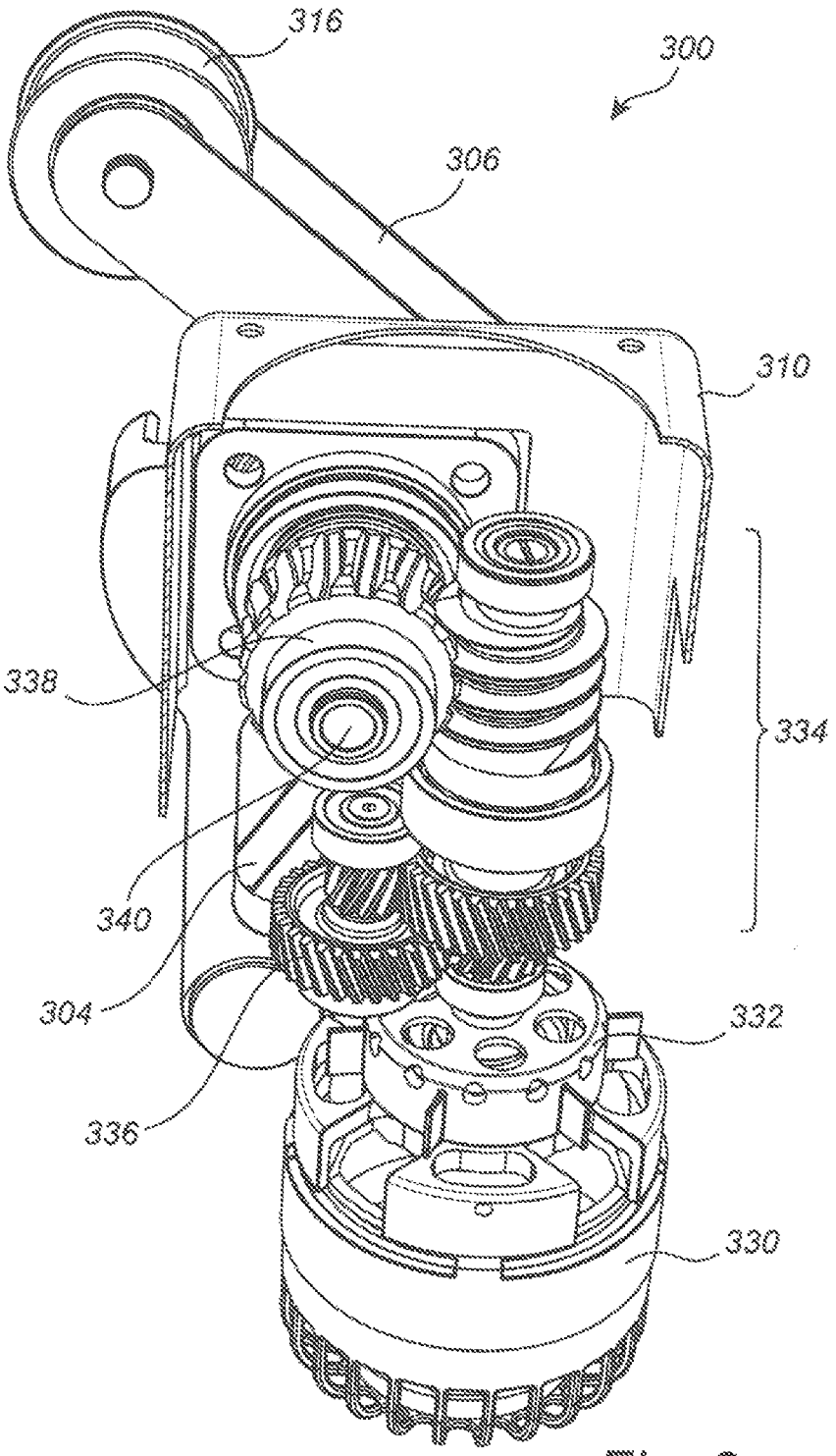

Turning now to FIGS. 3*a*-3*c*, providing a front and a back side view of a portable power driven system 300 provided with a rope grab 100 as discussed above. The portable power driven system 300 is provided with a securing device configured to force a rope 302 towards the rope grab 100 at a portion of the section where the rope 100, during operation, is engaging the rope grab 100. The securing device forms together with the rope grab 100 a rope grab arrangement.

In the illustration provided in FIG. 3*a*, the securing device comprises a first 304 and a second 306 lever portion. The first lever portion is at one end provided with a first hinged connection 308 to a main body 310 (typically including a "cover") of the portable power driven system 300. Furthermore, the first 304 lever is at the second end connected to one end of the second 306 lever by a second hinged connection 310. As can be seen from FIG. 3*a*, the second hinged connection 310 comprises a first roller 314 and a second roller 316 is arranged at the other end of the second lever portion 306.

During operation, the rope 302 is inserted to engage with a portion of the rope grab 100, typically being in contact with around half of the circumference of the rope grab 100. The rope will in addition extend in a first main direction 318 and as such engage with the second roller 316. Still further, the rope 302 will pass around a portion of the first roller 314. When operating the portable power driven system 300, a load will be connected to an anchoring point of the portable power driven system 300, in the illustration coinciding with the first hinged connection 308. The anchoring point may be provided with for example a sling 320 in turn connected to a maillon 322 for connecting to a harness of a user. The user will accordingly place a loading force 324 to the portable power driven system 300, where the loading force 324 will extend in an essentially opposite direction as compared to the main direction of the rope 302. The rope 302 will additionally have an unloaded end extending out from the first roller 314.

When loading the portable power driven system 300, the rope 302 will come in contact with the second roller 316, forcing it "away" from the rope grab 100. As this is happening, the first roller 314 will be forced 326 towards the rope 302 such that the rope 302 is at least partly "clamped" between the first roller 314 and the rope grab 100. Accordingly, as a force is provided to the rope 302 at a portion of the rope grab 100 where the rope 302 during operation of the portable power driven system 300 is engaged, an increased friction between the rope 302 and the rope grab 100 may be provided. This will, as mentioned above, allow for the use of a large variety of different types of ropes to be used with the portable power driven system 300.

FIG. 3*b* provides a detailed cross sectional view of the rope grab 100 when engaging with the rope 302. As will be seen, the pins 104 of the rope grab 100 are arranged in a "forward facing" direction as compared to the rotational direction of the rope grab 100 when the portable power driven system 300 is to ascend along the rope 302. This is a possible implementation of the rope grab 100 in relation to the pins 104, however, it may be possible to allow the pins 104 to be perpendicularly arranged in comparison to the rope engaging face 102 or the rope grab 100. As will be seen from FIG. 3*b*, the length of the pins 104 is selected to be such that the pins 104 preferably only penetrates the woven exterior sheath (mantle) 326 and not the interior core (the kern) 328.

Turning to FIG. 3*c* which illustrates a cross sectional view of a backside of the power driven system 300. In the illustrated embodiment, the power driven system 300 is provided with a motor 330 connected to a centrifugal clutch 332, thereby compensation of the weakness of the motor torque at the start phase of the motor 330. The motor 330 is preferably an electrical motor being optimized to have an in comparison high speed and low torque when being operated. The centrifugal clutch 332 is in turn connected to a gear arrangement 334, preferably comprising a first and a second stage. The first stage may be a general cog/wheel arrangement 336 known in the art and second stage preferably comprise a worm drive 338. As discussed above, the worm drive 338 is preferably configured to be self-locking. This has the advantages of not having to include a break mechanism with the portable power driven system 300, thus decreasing the cost and complexity of the portable power driven system 300. The worm drive 338 is in turn connected to a drive shaft 340 for allowing connection to the rope grab 100.

The electrical motor 330 is controlled in two directions, thus allowing the rope grab 100 to rotate in a first and a second direction. In vertical operation as will be discussed in relation to FIG. 4*b*, the self-locking functionality of the worm drive 338 will allow the portable power driven system 300 to stay still even when loaded (i.e. in a "hanging" position). Thus, for ascending the rope 302 the user will control the motor 330 to rotate in a first direction and conversely when descending the rope 302 the user will control the motor 330 to rotate in a second opposite direction. The control may be provided using a user interface, having a wired and/or wireless connection to a control unit (not shown) configured to operate the portable power driven system 300. The portable power driven system 300 is in addition preferably provided with a battery (not shown) for energizing the power driven system 300 during its operation.

Figure 4A:
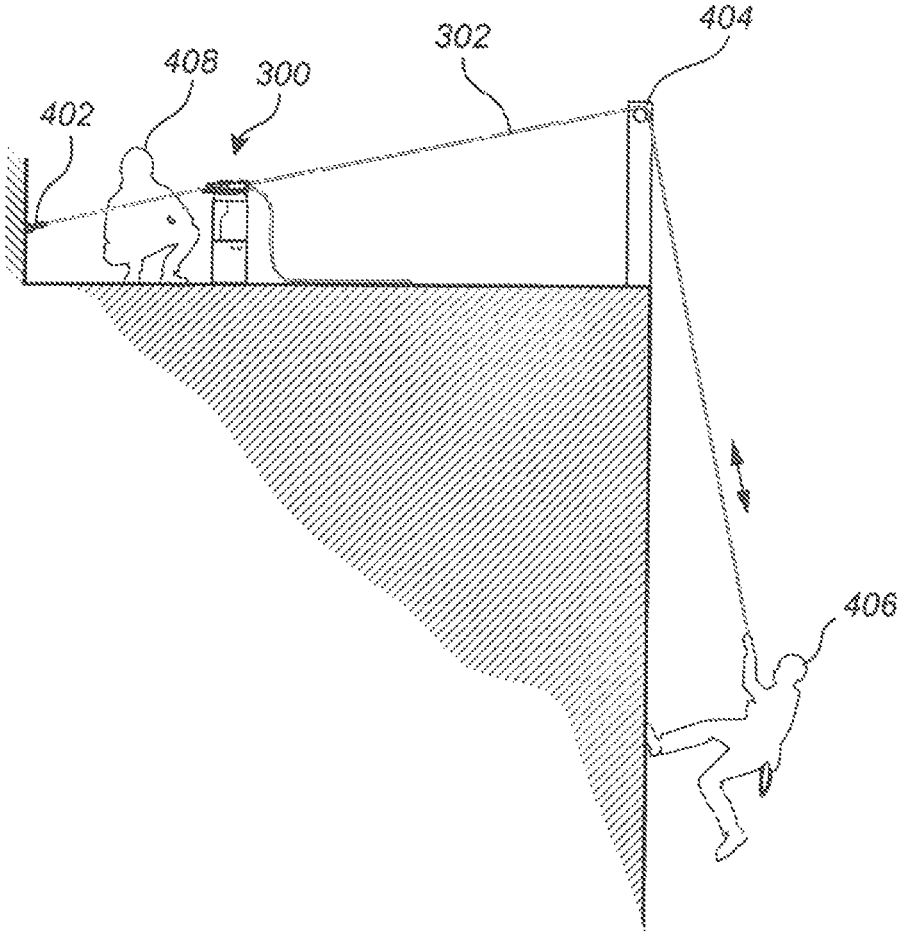
FIGS. 4*a* and 4*b* illustrate a horizontal and a vertical operation of the power driven system, respectively.
Figure 4B:
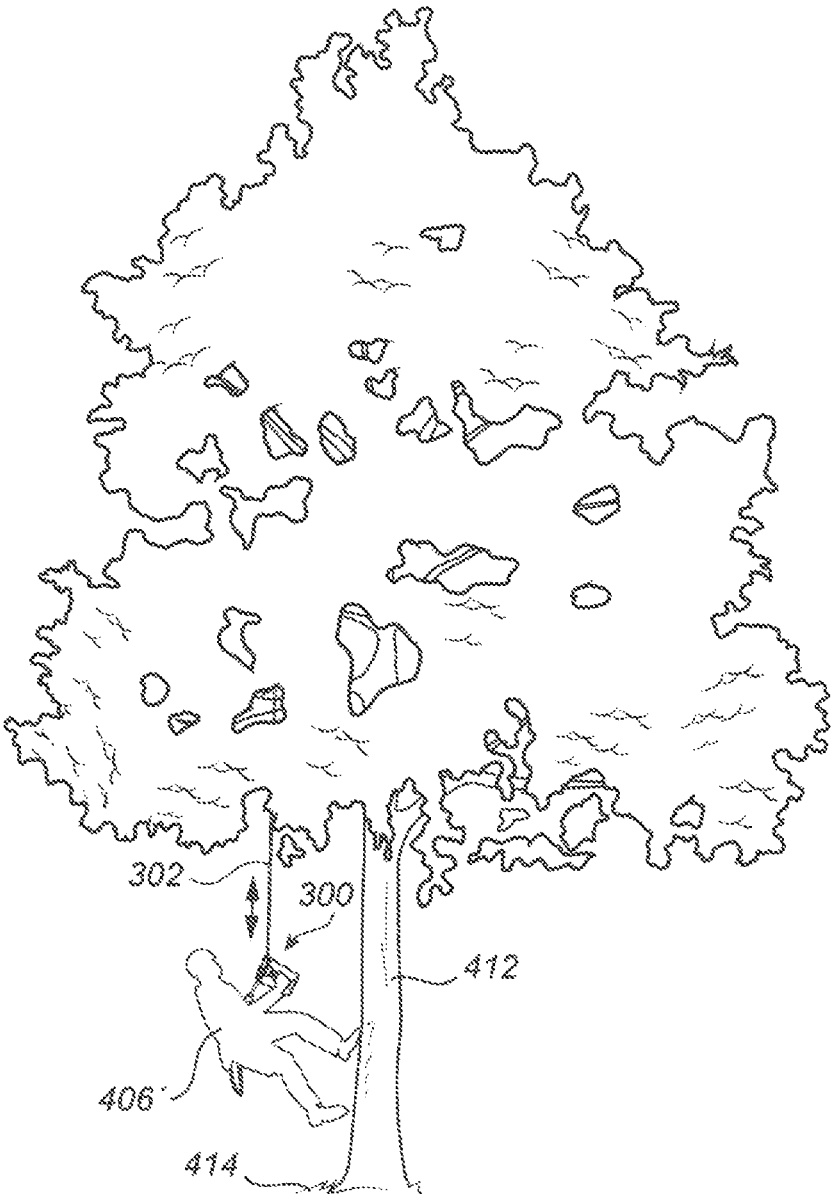

Turning now to FIGS. 4*a* and 4*b*, which illustrates the exemplary horizontal and vertical operation, respectively, of the power driven system 300. In the embodiment of FIG. 4*a*, the system 300 is arranged as a standalone winch mode, i.e. instead of the user connecting his/her safety harness directly to the anchoring point and using the system 300 to ascend/descend along the rope 302, the system 300 is in this mode connected to a fixed structure 402 such as a wall or similarly available object at the operational site.

In the illustrated example, the rope 302 is configured to pass over e.g. a roller 404 for the purpose of allowing a user 406 to be transported in a vertical manner without having to himself control the system 300. The system may instead (or also) be controlled by an operator 408 using a user interface (not shown), the operator 408 typically situated adjacently to the system 300. It may however be possible to configure the system 300 to additionally comprise means to be controlled from a distance, for example by means of a remote control (wired or wireless, not shown). Preferably, the control is wireless and in such an implementation the system 300 comprises wireless connection means to communicate wirelessly with the remote control.

In FIG. 4*b*, the typical vertical operation scenario for the power driven system 300 is shown. In this scenario, the user 406' having a safety harness is typically connected to the anchoring point of the portable power driven system 300. The rope 302 will in this case typically be arranged at a position above the user 406' (sometimes in relation to climbing denoted as "top rope"). FIG. 4*b* exemplifies the user 406' being an arborist accessing a tree 412, where the arborist 406' accesses the tree 412 from the ground level 414. During operation of the portable power driven system 300, the user 406' will operate the user interface for ascending/descending between the anchoring point and the ground level 414.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps. Additionally, even though the invention has been described with reference to specific exemplifying embodiments thereof, many different alterations, modifications and the like will become apparent for those skilled in the art. For example, even though the rope grab has been discussed to include a plurality of pins configured to at least partly penetrate the rope, it may be possible to refrain from including pins and instead solely use the rubber material as discussed above, where the rubber material is provided to at least partly cover the rope engaging face of the rope grab. In combination with the securing device as discussed above, such an implementation may be desirable when working with a selected range of ropes and still achieve a desirable level of friction between the rope and the rope grab.

The general description of the currently preferred embodiments of the invention has been given in relation to a securing device comprising a first and a second lever configured to interact with the rope by means of a first and a second roller connected to the levers. However, as indicated further above it would be possible, and within the scope of the invention, to provide the force 326 using other mechanical configurations. For example, a roller (comparable to the first roller 314 shown in FIG. 3*a*) may be arranged on a piston which pushes, by for example a spring, the roller towards the robe grab 100. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A rope grab arrangement for a portable power driven system, the portable power driven system configured for advancing a rope, the rope grab arrangement comprising:

an essentially circular rope grab, wherein the rope grab is configured to, during operation, engage the rope along at least a section of a circumference of the rope grab, wherein the rope grab is further configured to be connected to a drive shaft of a motor of the power driven system for rotation of the rope grab, and a securing device comprising a first roller, the securing device arranged adjacently to the rope grab and configured to, by means of the first roller, exert a pressure to the rope for forcing the rope towards the rope grab at a portion of the section where the rope, during operation, is engaging the rope grab, the pressure providing a force proportional to a loading force applied to the portable power driven system at an anchoring point, the rope encircling less than the entire circumference of the rope grab and an unloaded end of the rope extending out from the first roller, wherein a rope engaging face of the rope grab has a concave form for engaging the rope and the rope engaging face is provided with a plurality of pins configured to contact the rope along the section of the circumference of the rope grab engaging the rope during operation of the rope grab arrangement.

2. The rope grab arrangement according to claim 1, wherein the first roller of the securing device is arranged at the section of the circumference of the rope grab engaging the rope during operation of the rope grab arrangement.

3. The rope grab arrangement according to claim 1, wherein a length of the pins is selected to not fully pierce through the rope.

4. The rope grab arrangement according to claim 1, wherein the rope grab and the pins are manufactured from a metal material.

5. The rope grab arrangement according to claim 1, wherein the rope grab and the pins are manufactured as a single unit.

6. The rope grab arrangement according to claim 1, wherein the rope grab is assembled from a plurality of identical segments.

7. The rope grab arrangement according to claim 1, wherein the end of the pins provided to penetrate the rope has an angled form, having an angle between 0-45 degrees.

8. The rope grab arrangement according to claim 1, wherein the securing device further comprises a first elongated lever, the first elongated lever at a first end having a hinged connection to the portable power driven system and at a second end configured to receive the first roller.

9. The rope grab arrangement according to claim 8, wherein the securing device further comprises a second elongated lever, the second elongated lever at a first end having a hinged connection to the second end of the first elongated lever and at a second end provided with a second roller positioned to, during operation, engage with the rope at the section of the circumference of the rope grab.

10. The rope grab arrangement according to claim 1, wherein the securing device further comprises a spring mechanism for forcing the first roller towards the rope.

11. A portable power driven system for advancing a rope, the rope extending in a first main direction, the power driven system comprising:

a motor comprising a drive shaft;

a rope grab arrangement according to claim 1, the rope grab connected to the drive shaft of the motor for rotation of the rope grab, and a main body for mounting the motor and the rope grab arrangement, the main body further comprising an anchoring point adapted to receive an anchoring force, the anchoring force extending in a second direction being essentially opposite to the first main direction.

12. The portable power driven system according to claim 11, wherein the motor is an electrical motor, and the portable power driven system further comprises a gear arrangement connected in between the electrical motor and the rope grab, the gear arrangement configured to reduce a rotational speed of the rope grab as compared to a rotational speed of the motor.

13. The portable power driven system according to claim 12, wherein the gear arrangement comprises a worm drive.

14. The portable power driven system according to claim 13, wherein the worm drive is configured to be self-locking.

15. The portable power driven system according to claim 12, further comprising a centrifugal clutch connected between the motor and the gear arrangement.

16. A rope grab arrangement for a portable power driven system, the portable power driven system configured for advancing a rope, the rope grab arrangement comprising:

an essentially circular rope grab, wherein the rope grab is configured to, during operation, engage the rope along at least a section of a circumference of the rope grab, wherein the rope grab is further configured to be connected to a drive shaft of a motor of the power driven system for rotation of the rope grab, and a securing device comprising a first roller, the securing device arranged adjacently to the rope grab and configured to, by means of the first roller, exert a pressure to the rope for forcing the rope towards the rope grab at a portion of the section where the rope, during operation, is engaging the rope grab, the securing device further comprises a first elongated lever, the first elongated lever at a first end having a hinged connection to the portable power driven system and at a second end configured to receive the first roller, a second elongated lever, the second elongated lever at a first end having a hinged connection to the second end of the first elongated lever and at a second end provided with a second roller positioned to, during operation, engage with the rope at the section of the circumference of the rope grab, wherein a rope engaging face of the rope grab has a concave form for engaging the rope and the rope engaging face is provided with a plurality of pins configured to contact the rope along the section of the circumference of the rope grab engaging the rope during operation of the rope grab arrangement.

* * * * *